US005182598A

United States Patent [19]

Hara et al.

[11] Patent Number: 5,182,598

[45] Date of Patent: Jan. 26, 1993

[54] CONTROL MEANS FOR A TRANSFER CHARGER IN AN IMAGE FORMING APPARATUS

[75] Inventors: Yoshinobu Hara, Shinshiro; Shizuo Yuge, Toyokawa; Kazuyoshi Hara, Isehara, all of Japan

[73] Assignee: Minolta Camera Kabushiki Kaisha, Osaka, Japan

[21] Appl. No.: 762,404

[22] Filed: Sep. 19, 1991

[30] Foreign Application Priority Data

Sep. 20, 1990 [JP] Japan ..... 2-252349
Sep. 20, 1990 [JP] Japan ..... 2-252350

[51] Int. Cl.[5] ..... G03G 21/00

[52] U.S. Cl. ..... 355/208; 355/271; 355/275

[58] Field of Search ..... 355/271, 272, 274, 275, 355/276, 208, 203, 326, 327, 219; 361/225, 230; 250/324–326

[56] References Cited

U.S. PATENT DOCUMENTS 3,877,416 4/1975 Donohue et al. ..... 118/637
3,961,193 6/1976 Hudson ..... 250/324
4,772,918 9/1988 Karasawa et al. ..... 355/274
4,912,515 3/1990 Amemiya et al. ..... 355/274
5,012,293 4/1991 Aldrich et al. ..... 355/274
5,041,877 8/1991 Matsumoto ..... 355/271
5,041,878 8/1991 Takai et al. ..... 355/272 X

FOREIGN PATENT DOCUMENTS 5860756 4/1983 Japan .
0057364 4/1985 Japan .
0163778 6/1990 Japan ..... 355/271

*Primary Examiner*—A. T. Grimley
*Assistant Examiner*—William J. Royer
*Attorney, Agent, or Firm*—Burns, Doane, Swecker & Mathis

[57] ABSTRACT

An image forming apparatus wherein a toner image formed on a photosensitive member or a toner image once transferred therefrom to a transfer belt is transferred onto a copy sheet by a transfer charger, and the output of the transfer charger is controlled so as to apply a specified amount of charge to the copy sheet for fine image transfer. Specifically, an electric current flowing in the copy sheet is estimated based on an electric current flowing in the transfer belt when no sheets are on the belt, and the output of the transfer charger or alternatively a bias voltage impressed on a roller which supports the transfer belt is controlled so as to cause a specified value of electric current to flow in the transfer belt.

17 Claims, 7 Drawing Sheets

CONTROL MEANS FOR A TRANSFER CHARGER IN AN IMAGE FORMING APPARATUS

BACKGROUND OF THE INVENTION

1. Field of the Invention

The present invention relates to an image forming apparatus, and more particularly to a toner image transfer type electrophotographic image forming apparatus.

2. Description of Related Art

In the art of toner image transfer type electrophotographic copying apparatus, a toner image formed on a photosensitive member is transferred to a copy sheet by applying charge which has polarity opposite to the polarity of the toner to the copy sheet on the back side by a transfer charger, or in a full color copying apparatus, the toner image is once transferred to an intermediate transfer belt or drum, and then transferred to the copy sheet.

As for the toner image transfer to the copy sheet, though the transfer efficiency is hoped to be 100%, practically, it is deteriorated by environmental conditions (humidity, etc.), the material and the thickness of the copy sheet, and the like. Fine transfer efficiency can be maintained by controlling the output of the transfer charger, but minute adjustment of the transfer charger to the environmental conditions and the characteristics of the copy sheet is very difficult. Especially in the copying apparatus using the intermediate transfer belt, the problem appears clearly because the performance of the intermediate transfer belt comparatively depends on the environments.

In order to keep fine transfer efficiency, detecting the thickness of the copy sheet (Japanese Patent Laid Open Publication No. 58-17468), detecting a time constant of the copy sheet (Japanese Patent Laid Open Publication No. 58-60756), and detecting the humidity (Japanese Patent Laid Open Publication No. 60-44662) have been proposed.

However, the transfer efficiency can not be well controlled only by changing the output of the transfer charger according to the environmental conditions and the characteristics of the copy sheet. Also according to the result of the experiment, when an electric current flowing from the transfer charger to a toner image carrying member, namely the photosensitive member or the intermediate transfer belt, is an appropriate value, fine transfer efficiency is ensured regardless of the output (applied voltage) of the transfer charger.

SUMMARY OF THE INVENTION

An object of the present invention is to provide an image forming apparatus which keeps fine transfer efficiency regardless of changes of environmental conditions and the characteristics of copy sheets so that transferred images in high quality can be always obtained.

In order to attain the object, an image forming apparatus according to the present invention comprises a toner image carrying member; means for providing the toner image carrying member with a toner image; a tansfer charger facing the toner image carrying member; means for feeding a sheet between the toner image carrying member and the transfer charger; means for supplying electric power to the transfer charger; means for measuring electric charge applied to the sheet by the transfer charger; and means for controlling the power supplying means so as to apply a specified amount of charge to the sheet, based on the measurement result by the measuring means.

The specified amount of charge to be applied to the sheet means the amount of unit-area charge which is predetermined for the model of apparatuses from an experiment using an apparatus of the model. Before starting actual image formation in the apparatus, the amount of charge applied to the sheet is measured, and the power supplying means of the transfer charger is controlled in a feedback system using the measured value until the unit-area charge on the sheet becomes the predetermined amount. Thereby, fine transfer efficiency are ensured whatever the environmental conditions and the characteristics of the sheet are, and fine transferred images can be always obtained.

The amount of charge on the sheet can be detected also by comparing an electric current flowing from the transfer charger to the toner image carrying member directly with an electric current flowing from the transfer charger to the toner image carrying member via the sheet. Practically, this method of detecting the amount of charge on the sheet is suitable for such an image forming apparatus.

Another image forming apparatus according to the present invention comprises a toner image carrying member; means for providing the toner image carrying member with a toner image; a transfer charger facing the toner image carrying member; means for feeding a sheet between the toner image carrying member and the transfer charger; means for supplying electric power to the transfer charger; a conductive member disposed at the opposite side of the toner image carrying member from the transfer charger; means for applying a bias voltage to the conductive member; means for measuring an electric current flowing in the conductive member; and means for controlling the bias voltage applying means so as to cause a specified value of electric current to flow to the conductive member via the toner image carrying member, based on the measurement result by the measuring means.

The specified value of electric current flowing to the conductive member means a value predetermined for the model of apparatuses from an experiment using an apparatus of the model. Before starting actual image formation in the apparatus, an electric current flowing from the transfer charger to the conductive member via the toner image carrying member is measured, and the means for applying a bias voltage to the conductive member is controlled in a feedback system using the measured value until the electric current flowing to the conductive member via the toner image carrying member becomes the predetermined value. Thereby, fine transfer efficiency is ensured whatever the environmental conditions and the characteristic of the sheet are, and fine transferred images can be always obtained. Further, the bias voltage is low and is altered within a narrow range, and therefore the control is stable.

BRIEF DESCRIPTION OF THE DRAWINGS

This and other objects and features of the present invention will become apparent from the following description taken in conjunction with the preferred embodiments thereof with reference to the accompanying drawings, in which;

FIG. 1 is a schematic elevational view of the image forming apparatus showing its composition;

FIG. 2 is a flowchart of the main routine of a control procedure;

FIG. 3 is a flowchart of a subroutine which measures the transfer electric current during pre-rotation;

FIG. 4 is a flowchart of a subroutine which develops a latent image;

FIG. 5 is a flowchart of a subroutine of the first transfer processing;

FIG. 6 is a flowchart of a subroutine which measures and controls the transfer current while feeding a copy sheet;

FIG. 7 is a schematic elevational view of the image forming apparatus showing its composition;

FIG. 8 is a graph plotting voltage applied to the transfer charger versus transfer current under different bias voltages; and FIG. 9 is a graph plotting voltage applied to the transfer charger versus transfer currents flowing through a sheet and not through a sheet.

DETAILED DESCRIPTION OF THE PREFERRED EMBODIMENTS

Figure 1:
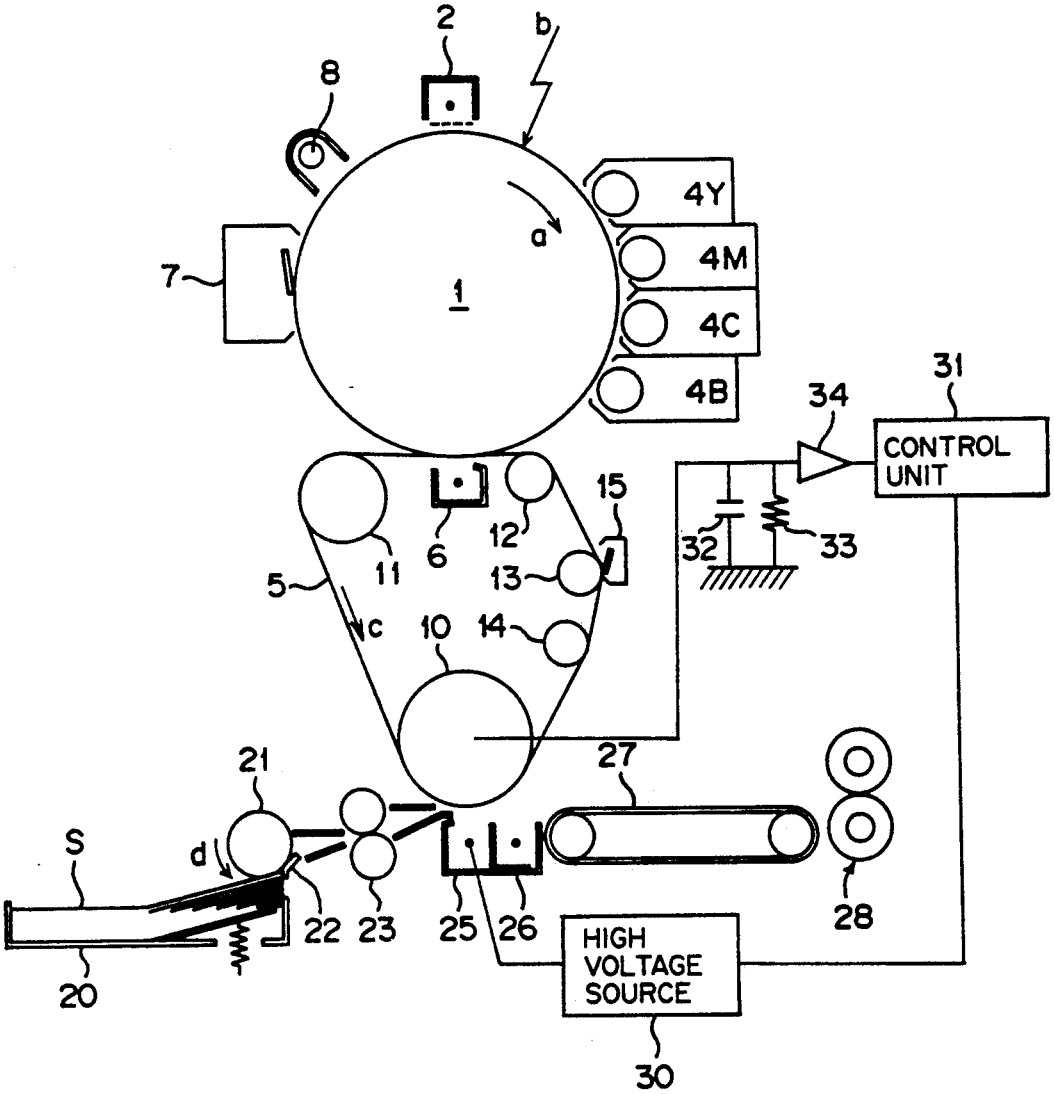
FIGS. 1–6 show a first embodiment of an image forming apparatus according to the present invention.

The description of preferred embodiments according to the present invention is given below, referring to the drawings.

FIRST EMBODIMENT: FIGS. 1-6

FIG. 1 shows a full color copying apparatus according to the present invention. An electric charger 2, developing devices 4Y, 4M, 4C and 4B, an intermediate transfer belt 5, a residual toner cleaning device 7, and a residual charge erasing lamp 8 are installed around a photosensitive drum 1 which rotates in the direction of an arrow a. The photosensitive drum 1 is exposed to a light from the direction of an arrow b through an optical system (not shown), and an electrostatic latent image corresponding to an image of an original which is set on an original supporting glass (not shown) is formed thereon. The developing device 4Y contains a developer including a yellow toner, the developing device 4M contains a developer including a magenta toner, the developing device 4C contains a developer including a cyan toner, and the developing device 4B contains a developer including a black toner. Each developing device is operated selectively.

The intermediate transfer belt 5 which is set on rollers 10, 11, 12, 13 and 14 endlessly rotates in the direction of an arrow c led by a rotation of a driving roller 11 at the same speed as the photosensitive drum 1. The transfer belt 5 is made of polyurethane rubber or EPDM (terpolymer ternary polymerized of ethylene, propylene and dien) of which volume resistivity is about $1\times10^{10}$-$1\times10^{13}\Omega$ cm, and formed in belt-shape of which thickness is approximately 600 μm. A surface of the transfer belt 5 is covered by 10-30 μm thick fluorine-contained water paint of which volume resistivity is about $1\times10^{9}$-$1\times10^{12}\Omega$ cm to obtain smoothness and a toner separating characteristic.

The roller 10 is a conductive member and functions as a counter electrode for second transfer explained below. Inside the ring of the intermediate transfer belt 5, a first transfer charger 6 is set in the opposite position of the photosensitive drum 1. Also, around the intermediate transfer belt 5, a second transfer charger 25 and an AC separation charger 26 are set in the opposite side of the electrode roller 10, and a residual toner cleaning device 15 is set removably in the opposite side of the back up roller 13.

Copy sheets S which are contained in an automatic sheet feeding cassette 20, which is removable from the copying apparatus, are fed one by one to the second transfer section by a rotation of the sheet feeding roller 21 in the direction of an arrow d and a separation plate 22 which contacts with the sheet feeding roller 21 with slight pressure. Also a sensor to detect the size of the copy sheets S contained in the cassette (the sensor is of a well-known type) is set in the sheet feeding section. A copy sheet passage is composed of various guide plates, a pair of timing rollers 23, a conveyer belt 27, and a fixing device 28.

In the above composition, in a mono color copy mode, negative polarity charge is applied uniformly to a surface of the photosensitive drum 1 by the electric charger 2, and then the surface of the photosensitive drum 1 is exposed to the light from the optical system (not shown) to form an electrostatic latent image according to an original image thereon. This electrostatic latent image is developed by a positively charged toner of a preselected developing device among the developing devices 4Y, 4M, 4C and 4B. Then the toner image is transferred onto the intermediate transfer belt 5 in an electric field which is formed by the negative electric charge generated from the first transfer charger 6. After that, the toner image is transferred onto a copy sheet S in an electric field which is formed by the negative electric charge generated from the second transfer charger 25. After the second transfer, the charge on the copy sheet S is removed therefrom in an AC electric field which is formed by the AC separation charger 26, and released from the intermediate transfer belt 5. Then the toner thereon is fixed by heat in the fixing device 28 and ejected to a tray (not shown).

In a full color copy mode, an original image is color-separated into a yellow image, a magenta image, a cyan image and a black image. The images are each formed on the photosensitive drum 1 as electrostatic latent images, and developed by the respective developing devices 4Y, 4M, 4C and 4B. Then the toner images are transferred one by one to the intermediate transfer belt 5 and are overlaid thereon. During the process, the copy sheet S is not fed, and the second transfer charger 25 and the separation charger 26 are off. The cleaning device 15 which is set away from the intermediate transfer belt 5 also stops cleaning operation. After the four kinds of toner images are overlaid on the intermediate transfer belt 5, a copy sheet S is fed, and the second transfer charger 25 and the separation charger 26 are turned on, and then the full color toner image is transferred onto the copy sheet S.

In this embodiment, to keep good transfer efficiency, the second transfer charger 25 is controlled to apply a specified amount of charge to any copy sheet on its back side regardless of changes of environmental conditions or the size and thickness of the copy sheet.

According to the result of an experiment conducted by the inventors, when unit-area charge of the copy sheet is an appropriate value, fine transfer efficiency is ensured regardless of the output (applied voltage) of the transfer charger.

A copying experiment using the above-described copying apparatus proves that when the charge C applied to the copy sheet by the second transfer charger 25 is 0.04 $\mu C/cm^2$, the copying apparatus shows fine transfer quality. When the charge C is smaller than the optimal value, the transfer efficiency is lowered. When the charge C is larger than the optimal value, electric discharge causes unevenness of the toner charge, and then the transfer efficiency is lowered, which deteriorates picture quality. Although in this case 0.04 $\mu C/cm^2$ is figured out to be an optimal value to realize fine transfer efficiency, such an optimal value depends on the toner used and the system speed of the copying apparatus.

The unit-area charge C of a copy sheet can be measured directly immediately after the sheet comes out of the second transfer section, and it also can be detected by measuring an electric current flowing to the electrode roller 10 only through the intermediate transfer belt 5, and an electric current flowing to the electrode roller 10 through the copy sheet and the intermediate transfer belt 5. Because various sizes of sheets are used as the copy sheets, the unit-area charge C is calculated according to the following expression (1).

$$C = \frac{i3}{V0} = \frac{1}{V0}\left(\frac{1}{W}\cdot I2 - \frac{W0 - W}{W - W0}\cdot I1\right) \quad (1)$$

i3: unit-length electric current flowing in the copy sheet
V0: system speed
W: width of the copy sheet
W0: length of the second transfer charger
I1: electric current flowing to the electrode roller only through the intermediate transfer belt
I2: electric current flowing to the electrode roller through the copy sheet and the intermediate transfer belt Fine transfer efficiency can be kept by controlling a high voltage source 30 of the second transfer charger 25 to keep the calculated charge C substantially equal to the optimal value (0.04 $\mu C/cm^2$ in the embodiment). Measuring electric currents I1 and I2 is required to control the second transfer charger 25 in this manner.

To realize this system, as it is shown in FIG. 1, a capacitor 32 and a resistor 33 are inserted between the electrode roller 10 and a ground, and the circuit is connected to an amplification circuit 34. Then the electric current i3 is calculated based on the electric currents I1 and I2 at a control unit 31. As it is apparent from the expression (1), the charge C correlates with the unit-length electric current i3 flowing in the copy sheet, and can be rewritten to the following expression (2).

$$i3 = \frac{1}{W}\cdot I2 - \frac{W0 - W}{W\cdot W0}\cdot I1 \quad (2)$$

A standard value i0 of the unit-length electric current according to the optimal unit-area charge (0.04 $\mu C/cm^2$) can also be estimated beforehand from an experiment. Therefore, in the copying operation, the value i3 is calculated based on the electric currents I1 and I2, and then the high voltage source 30 is so controlled that the calculated value i3 is equal to the standard value i0.

The electric current I1 is measured during a pre-rotation of the photosensitive drum 1 and the intermediate transfer belt 5 when the print switch is turned on. During the pre-rotation, a specified voltage is applied to the second transfer charger 25, and the current I1 which flows to the electrode roller 10 through the intermediate transfer belt 5 is measured, and the measured value is stored in the control unit 31. Information on the width W of the copy sheet S detected by the copy sheet size sensor (not shown) which is installed in the feeding section is also stored in the control unit 31.

When an actual copying operation is started after the pre-rotation, first the specified voltage is applied to the second transfer charger 25 during the second transfer, and the current I2 flowing to the electrode roller 10 through the copy sheet and the intermediate transfer belt 5 is measured. Then, the length-unit electric current i3 flowing in the copy sheet is calculated based on the expression (2). An output of the high voltage source 30 is controlled realtime to make the current i3 equal to the standard value i0.

Because the current I1 correlates with the current I2 to a certain extent, the current i3 can be controlled more promptly by controlling the output of the high voltage source 30 to make the current I1 equal to the predetermined standard value i0.

Control of the second transfer current has been described above. A first transfer current I4 which flows in the transfer belt 5 in the electric field which is formed by the first transfer charger 6 correlates with the second transfer current I1. Therefore, an optimal value of the first transfer current I4 can be estimated based on the current I1 and the voltage applied to the second transfer charger 25 at that time. In the embodiment, the output of the first transfer charger 6 is also controlled based on a result of the second transfer measured during the prerotation.

A definite control procedure is explained below referring to the flowcharts of FIGS. 2 through 6.

Figure 2:
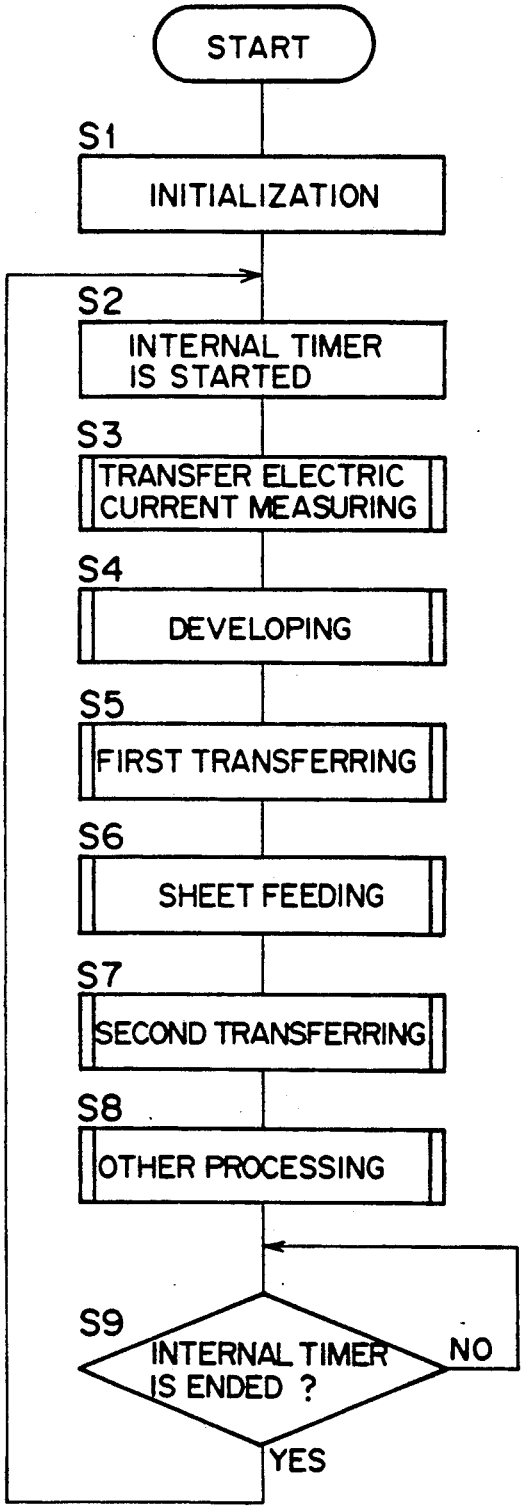

FIG. 2 shows a main routine of copying operation. When the print switch is turned on, the parameter such as flags is reset at step S1, and an internal timer is started at step S2. The width W of copy sheets which are contained in the feeding cassette 20 is detected at step S1 and memorized.

Then each subroutine is called successively at steps S3 through S8 for required processing, and when an end of the internal timer is confirmed at step S9, the processing goes back to step S2. In the subroutine of step S3, the second transfer current I1 is measured and adjusted during the prerotation, and at the same time a power source of the first transfer charger 6 is also adjusted. In the subroutine of step S4, an image is developed by the developing devices 4Y, 4M, 4C and 4B. In the subroutine of step S5, the toner image is transferred from the photosensitive drum 1 to the intermediate transfer belt 5. In the subroutine of step S6, a copy sheet is fed, and at the same time the second transfer current I2 is measured and adjusted. In the subroutine of step S7, the toner image is transferred from the intermediate transfer belt 5 to the copy sheet. In the subroutine of step S8, other processing such as exposure of an original image, detection of sheet jamming are operated.

Figure 3:
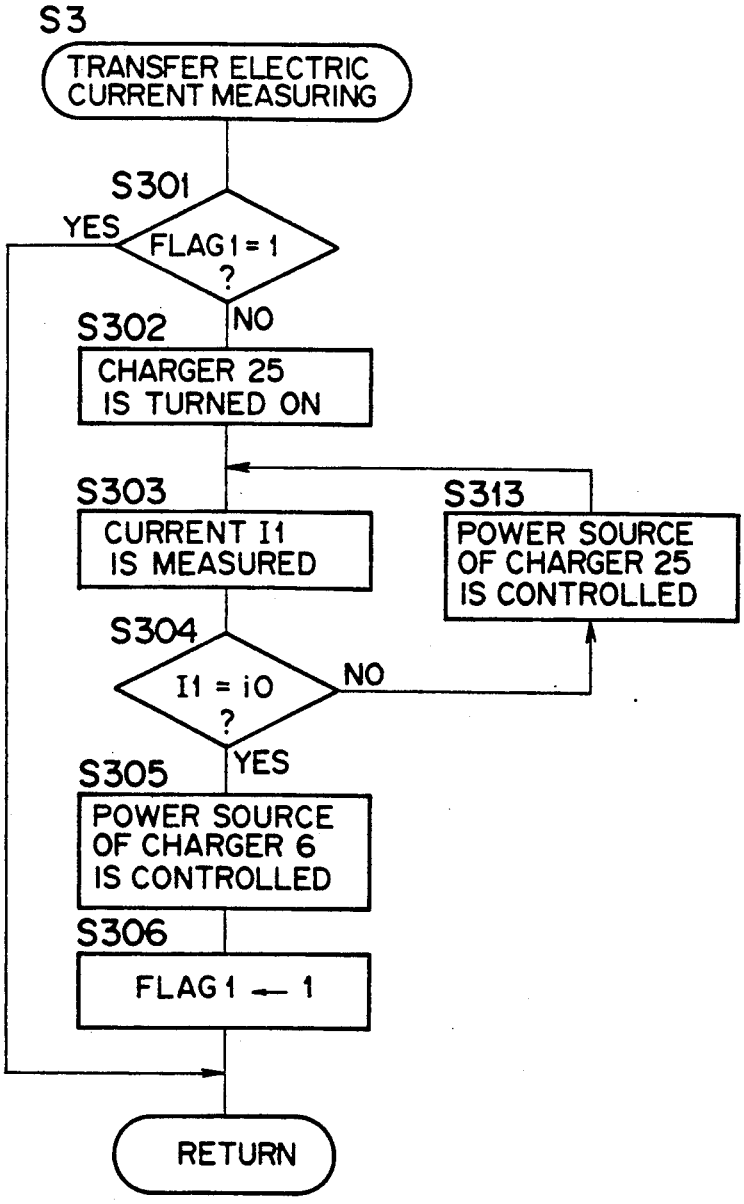

FIG. 3 shows the subroutine of step 3. The processing here is conducted during the pre-rotation of the photosensitive drum 1 and the intermediate transfer belt 5.

First, at step S301, whether a flag 1 is "1" or not is judged. That the flag 1 is "1" means that the processing of this subroutine is already completed. Therefore, when the flag 1 is "1", the processing goes back to the main routine immediately. When the flag 1 is "0", the second transfer charger 25 is turned on at step S302, and impressed with a specified voltage by the high voltage source 30. Then at step S303, the electric current I1 which flow to the electrode roller 10 through the intermediate transfer belt 5 is measured, and at step S304, the measured value of the electric current I1 and the predetermined standard value i0 are compared. When the electric currents I1 and i0 are not equal, the high voltage source 30 is controlled at step S313 to make the electric current I1 equal to the standard value i0. After that, at step S305, the output voltage of the first transfer charger 6 is adjusted based on the electric current I1 and the output value of the high voltage source 30 at that time, and the flag 1 is set to "1" at step S306.

Figure 4:
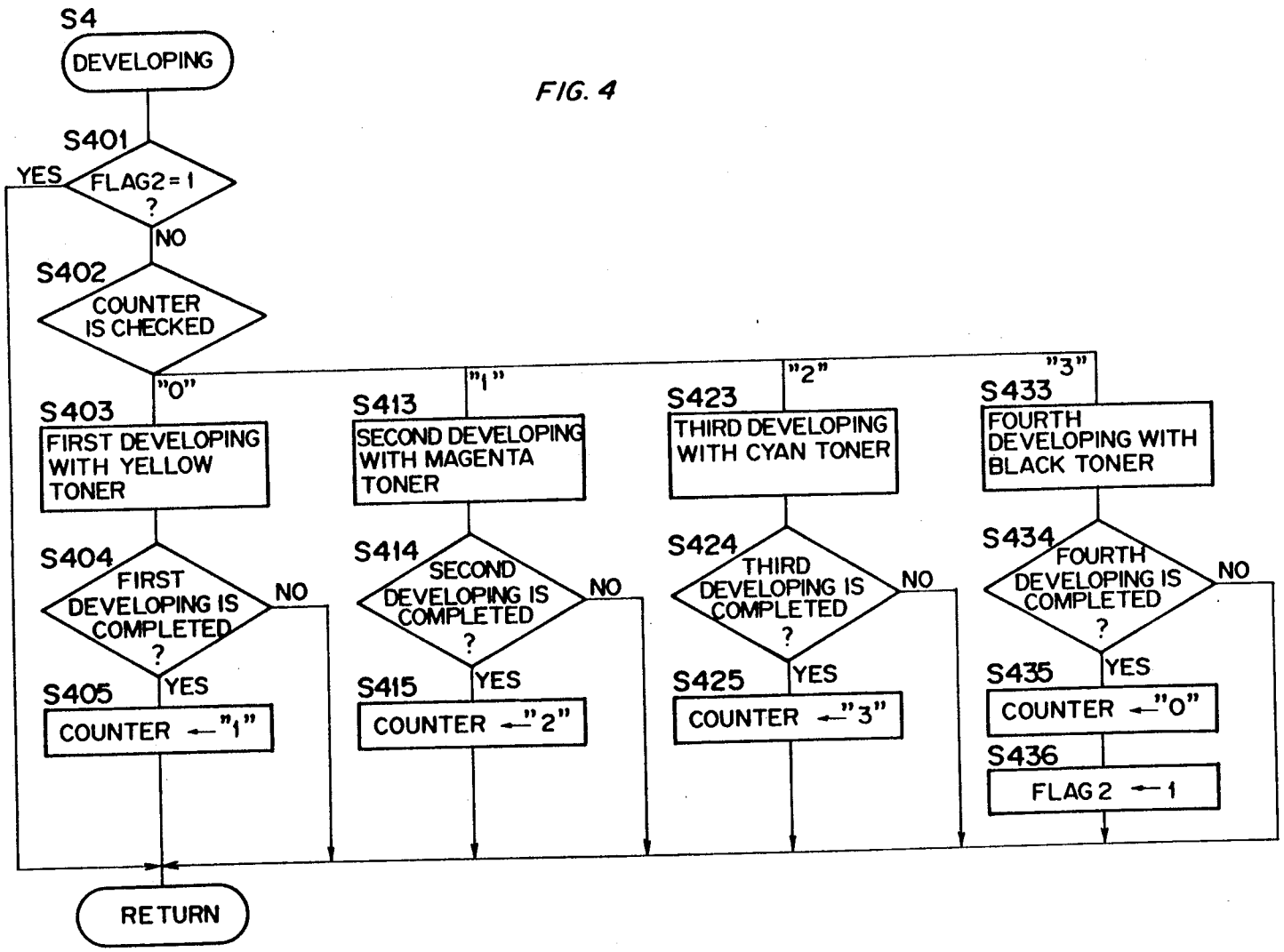

FIG. 4 shows the subroutine of step S4. Here, the electrostatic latent images formed on the photosensitive drum 1 corresponding to three color images and a black image are developed selectively by the developing devices 4Y, 4M, 4C and 4B.

First, at step S401, whether a flag 2 is "1" or not is judged. That the flag 2 is "1" means that the processing of this subroutine is already completed. Therefore, when the flag 2 is set to "1", the processing goes back to the main routine. When the flag 2 is "0", a counter is checked at step S402, and developing processing described below is conducted based on the counter value.

When the counter value is "0", first developing processing is conducted using the developing device 4Y at step S403. When the completion of this processing is confirmed at step S404, the counter is set to "1" at step S405.

When the counter value is "1", second developing processing is conducted using the developing device 4M at step S413. When the completion of the processing is confirmed at step S414, the counter value is set to "2" at step S415.

When the counter value is "2", third developing processing is conducted using the developing device 4C at step S423. When the completion of the processing is confirmed at step S424, the counter is set to "3" at step S425.

When the counter value is "3", forth developing processing is conducted using the developing device 4B at step S433. When the completion of the processing is confirmed at step S434, the counter is reset to "0" at step S435, and the flag 2 is set to "1" at step S436.

The above-described processing is conducted in the full color copy mode. In the mono color copy mode, the counter is set to the value according to the developing device which is selected by the operator beforehand. On the completion of the developing processing, the counter is reset to "0" and the flag 2 is set to "1".

Figure 5:
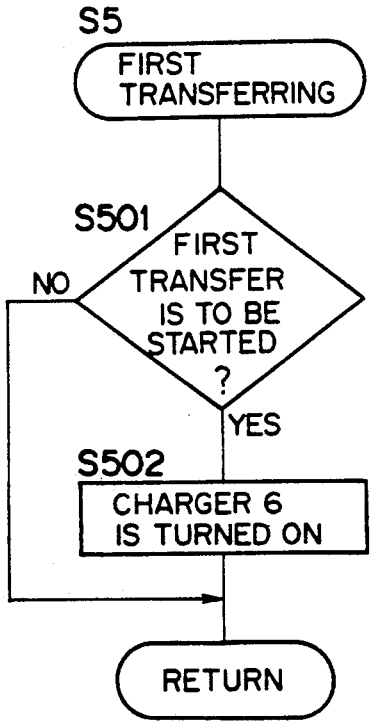

FIG. 5 shows the subroutine of step S5.

When it is judged at step S501 that the first transfer is to be started, the first transfer charger 6 is turned on at step S502, and the toner image which is formed on the photosensitive drum 1 is transferred to the intermediate transfer belt 5.

Figure 6:
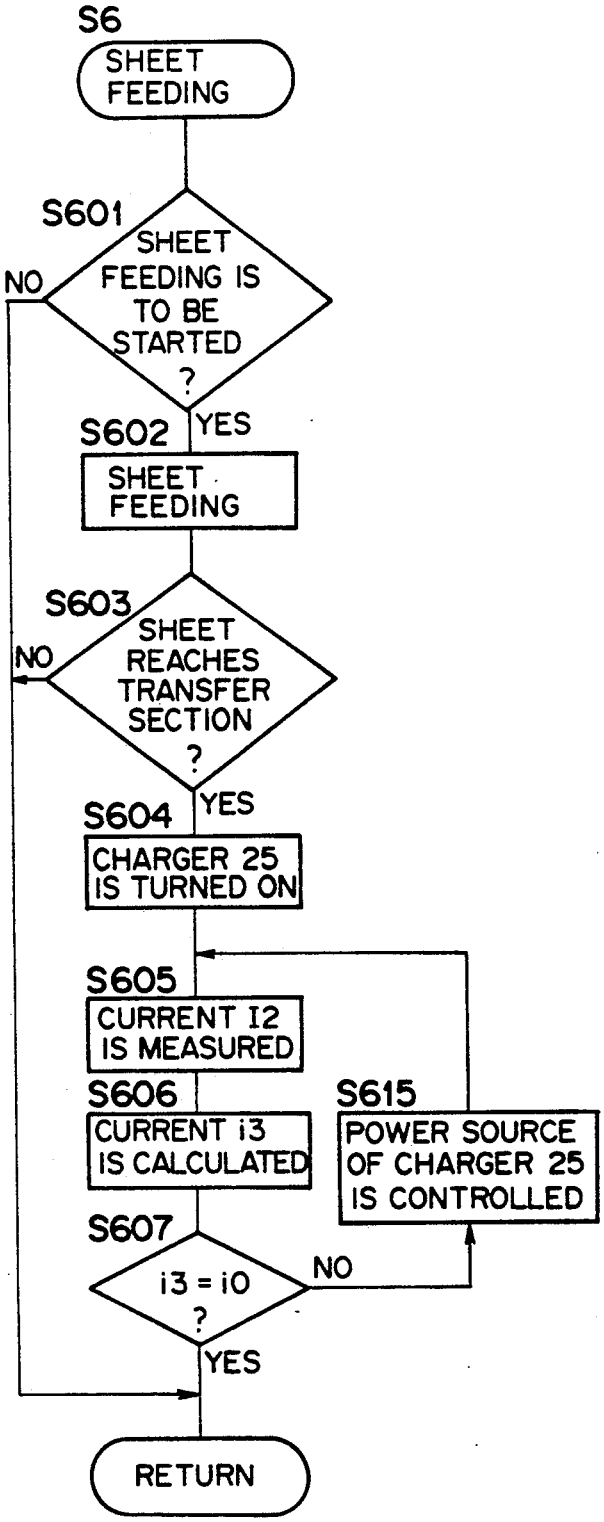

FIG. 6 shows the subroutine of step S6. Here, the second transfer electric current I2 is adjusted, and the toner image is transferred from the intermediate transfer belt 5 to a copy sheet S.

First, when it is judged at step S601 that the sheet feeding is to be started, the sheet feeding processing such as controlling the rotation of the pair of timing rollers 23 and the feeding roller 21 is conducted at step S602. Then whether the copy sheet S reaches the second transfer section or not is judged at step S603. When the copy sheet S reaches the second transfer section, the second transfer charger 25 is turned on a step S604, and the high voltage source 30 applied the voltage determined in the adjusting processing at steps S303, S304 and S313 to the second charger 25 to cause flow of the electric current I1 in accordance with the standard value i0. Then the electric current I2 which flows to the electrode roller 10 through the copy sheet S and the intermediate transfer belt 5 is measured at step S605, and at step S606, the unit-area current i3 flowing in the copy sheet S is calculated based on the expression (2).

Next, the electric current i3 and the predetermined standard value i0 are compared at step S607. When the electric current i3 is not equal to the standard value i0, the high voltage source 30 is adjusted at step S615, and the above processing at steps S605, S606 and S607 is repeated until the electric current i3 becomes equal to the standard value i0. The subroutine is completed when the electric current i3 becomes equal to the standard value i0.

Conducting the above processing, the electric current flowing in the copy sheet S can be controlled accurately, and a fixed amount of electric charge can be applied to any copy sheet. Thereby fine transfer efficiency is ensured, and copy images in high quality can be obtained. The output of the first transfer charger 6 can be controlled based on the measured value of the electric current I1.

In the first embodiment, the second transfer current I2 is controlled simultaneously with the image transfer to a copy sheet. However, it is possible to separately set a trial-print mode wherein a single copy sheet is fed for the processing at steps S3 and S6 to control the second transfer current I2. Then the output of the second transfer charger 25 is fixed during successive operation in a regular copy mode.

Also, in the apparatus of the first embodiment, various sizes of copy sheets are used, and not the entire of the second transfer charger 25 may face a copy sheet fed to the transfer belt 5 depending on the size of the sheet. For this reason, the electric current i3 flowing in the copy sheet is estimated by the operation.

However, in an apparatus wherein the length of the charger 25 is equal to the width of a copy sheet fed to the transfer belt 5 (an apparatus wherein only one size of copy sheets are used), only the measurement of the electric current I1 flowing to the electrode roller 10 through the transfer belt 5 and the copy sheet is enough for adjustment of the high voltage source 30. The high voltage source 30 is to be controlled to keep the current I1 a predetermined optimal value.

Figure 7:
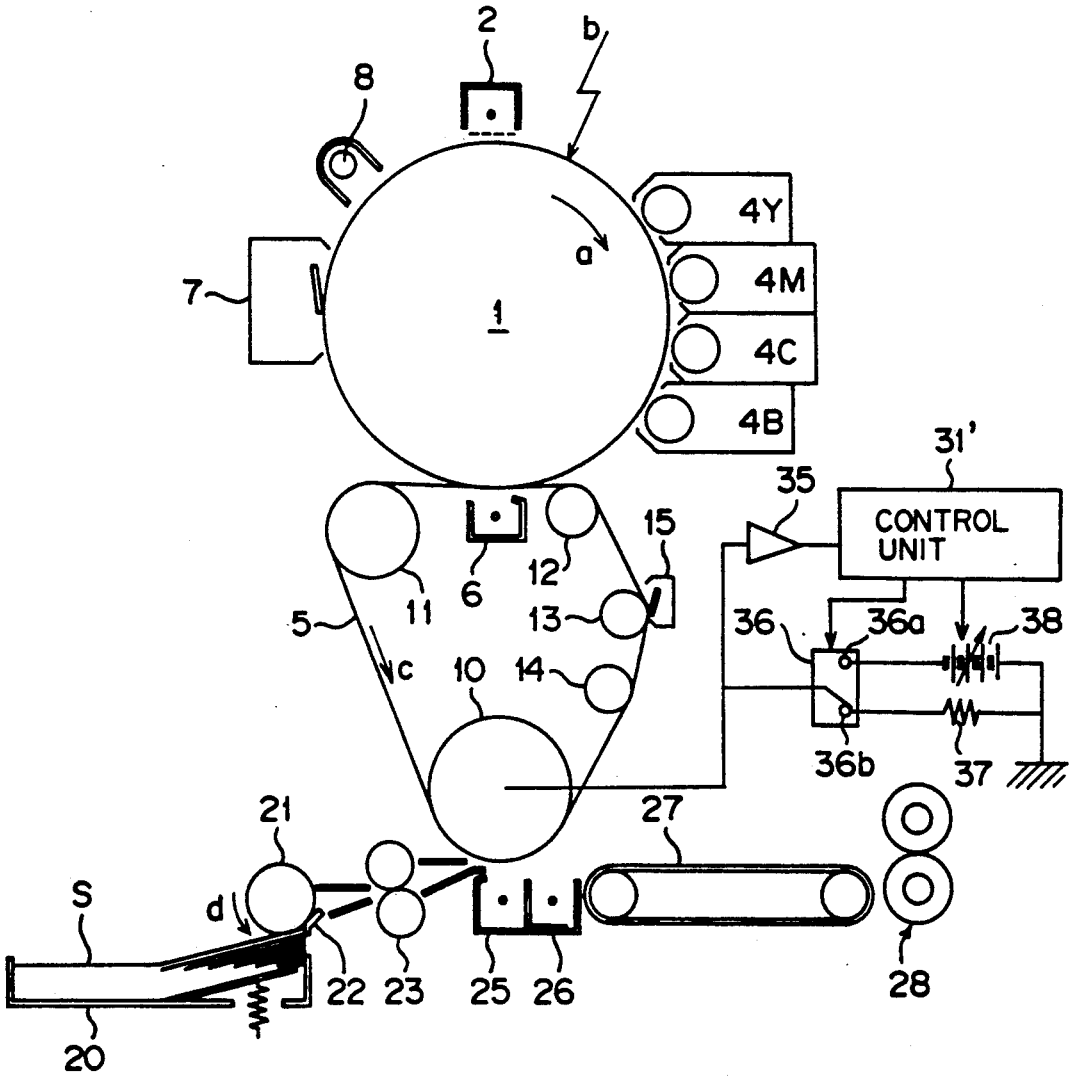
FIGS. 7-9 show a second embodiment of the image forming apparatus according to the present invention.
Figure 8:
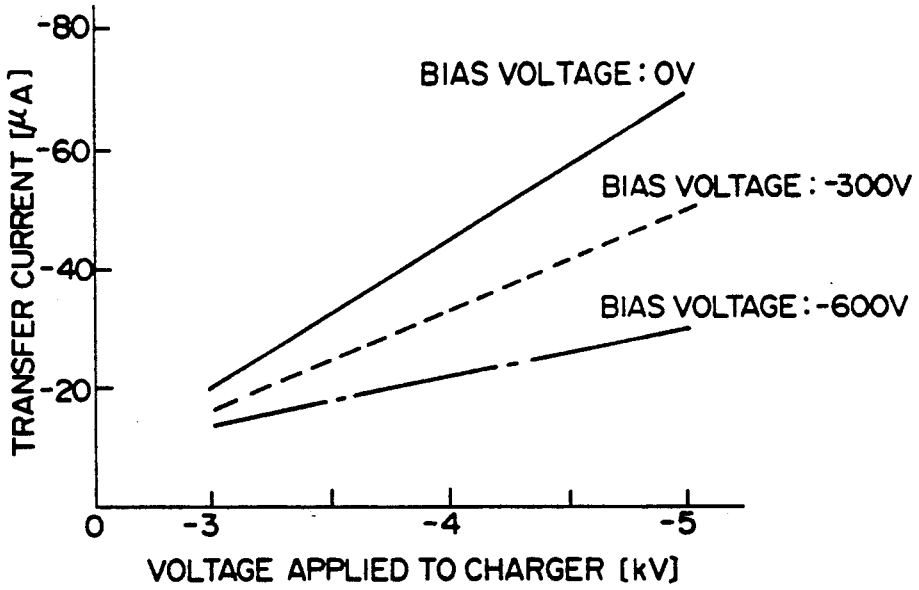
Figure 9:
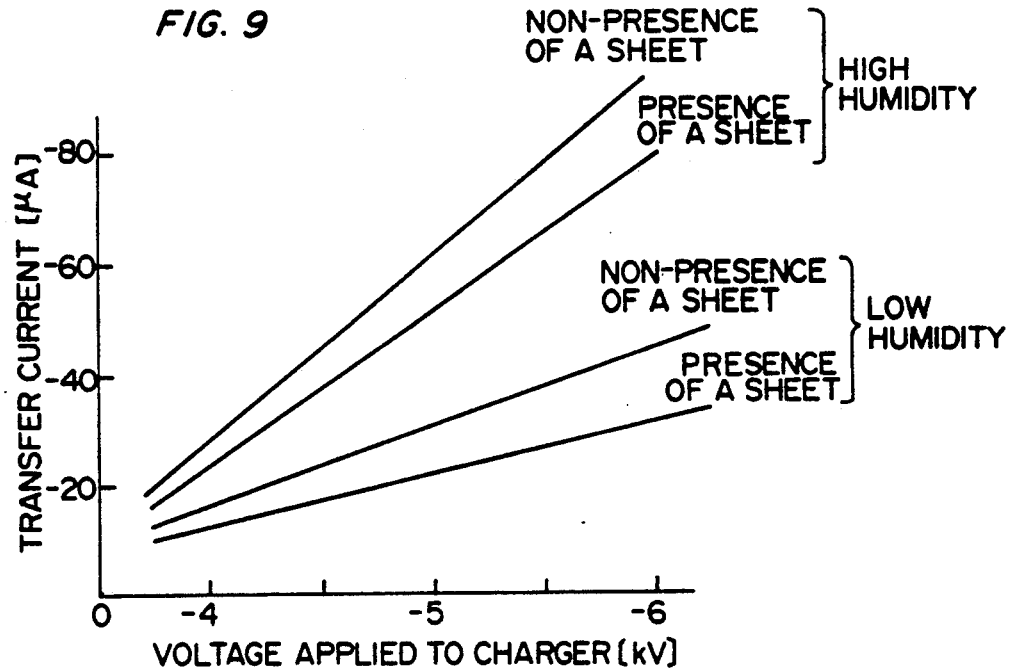

Second Embodiment: FIGS. 7–9

As shown in FIG. 9, an electric current flowing in the intermediate transfer belt caused by applying a voltage to the transfer charger when a copy sheet is not in the transfer section correlates with an electric current flowing in the belt caused by applying the same voltage to the transfer charger when a copy sheet is in the transfer section. Accordingly, the latter can be estimated from the former. In other words, whatever environmental conditions (mainly humidity) are, the current flowing in the copy sheet can be estimated only by measuring the current flowing in the transfer belt when no copy sheets are in the transfer section. In order to keep fine transfer efficiency, resulting in forming quality images constantly, the output of the transfer charger should be so controlled that the estimated current will be kept a specified standard value. The essential factor of the transfer efficiency is the amount of charge on the copy sheet, that is, the electric current flowing in the copy sheet. The electric current flowing in the copy sheet can be controlled by changing a bias voltage applied to the electrode roller as well as by changing the output of the transfer charger.

In a second embodiment, therefore, in order to keep fine transfer efficiency, the bias voltage applied to the electrode roller is so controlled that the current flowing from the transfer charger to the electrode roller through the intermediate transfer belt is kept a standard value regardless of changes of environmental conditions.

FIG. 7 shows a full color copying apparatus of the second embodiment. This apparatus comprises the same type of image forming elements as the apparatus of the first embodiment illustrated in FIG. 1, and the image formation process is basically the same as the apparatus of the first embodiment. In FIG. 7, the same elements are referenced by the same numbers as in FIG. 1, and the description of these elements is omitted.

From an experiment using this apparatus, the following became apparent: the electric current flowing from the second transfer charger 25 to the intermediate transfer belt 5 determines the quality of the second image transfer, and fine transfer efficiency is ensured by controlling the transfer current appropriately by changing the bias voltage applied to the electrode roller 10 without changing the voltage applied to the second transfer charger 25. If the transfer current is smaller than a standard value, the transfer efficiency is lowered. If the current is larger than the standard value, electric discharge occurs, which causes uneven charging on the toner, and the transfer efficiency is lowered.

FIG. 8 shows correlation between the transfer current and the voltage applied to the transfer charger 25 when the electrode roller 10 is impressed with different negative bias voltages. In the graph of FIG. 8, the axis of abscissas represents the voltage applied to the second transfer charger 25 (the unit of the values is kilovolt), and the axis of ordinates represents the current flowing in the intermediate transfer belt 5 (the unit of the values is microampere). For example, when the voltage applied to the second transfer charger 25 is −5 kV, the transfer current can be altered within a range of −30 to −70 μA by changing the bias voltage within a range of 0 to −600V. The standard value of the transfer current to obtain fine transfer efficiency can be determined from an experiment beforehand. In order to obtain the transfer current of the standard value, e.g., −50 μA, if −5 kV of voltage is applied to the transfer charger 25, −300kV of bias voltage should be applied to the electrode roller 10.

However, the intermediate transfer belt 5 is largely influenced by the environments, and the transfer current varies in accordance with environmental conditions at the time of operating the apparatus even if the installation conditions of the apparatus are fixed. In the light of this problem, the transfer current is measured before copying operation, and the measured value I1 is compared with the predetermined standard value I0. Then, the bias voltage is controlled to make the transfer current I1 equal to the standard value I0, which results in keeping fine transfer efficiency.

A structure to realize the measurement of the transfer current and the control of the bias voltage is hereinafter described referring to FIG. 7. A microresistor 37 for converting an electric current into a voltage and a bias voltage source 38 which can emit various voltages are inserted between the electrode roller 10 and a ground, and a switch 36 is disposed before the microresistor 37 and the bias voltage source 38 so as to connect the electrode roller 10 selectively with the microresistor 37 or the voltage source 38. Further, an output amplification circuit 35 and a control unit 31' are provided. The measurement of the transfer current and the control of the bias voltage are performed at the time of turning on the print switch while the photosensitive drum 1 and the transfer intermediate belt 5 are rotated preliminarily. During the pre-rotation, the switch 36 is set to communicate with a terminal **36*b*, and a specified voltage is applied to the second transfer charger 25. The electric current I1 which flows to the electrode roller 10 through the intermediate transfer belt 5 at that time is converted into a voltage V1 by the microresistor 37, and the voltage V1** is measured. This is represented by the following expression.

$$V1 = I1 \times \Omega$$

I1: electric current flowing to the electrode roller Ω: resistance of the microresistor The voltage V1 is amplified by the amplification circuit 35, and compared with a standard value V0 which was memorized in the control unit 31' in advance. The value V0 is expressed as follows.

$$V0 = I0 \times \Omega$$

I0: standard value of the transfer current

Next, the control unit 31' operates a bias voltage V' required to make the voltage V1 equal to the standard value V0, and the bias voltage source 38 is controlled to output the voltage V'. At the same time, the switch 36 is switched to a terminal **36*a* so as to connect the bias voltage source 38 with the electrode roller 10 and to turn off the second transfer charger 25**.

The current flowing in the intermediate transfer belt 5 is controlled in this manner, such that fine transfer efficiency is always ensured, resulting in transferred images in high quality. In this manner, it is not required to control the high voltage applied to the second transfer charger 25. The bias voltage which is controlled in this embodiment is low and altered within a narrow range of 0 to 500V, which control is quick and stable.

As described in connection with the first embodiment, the first transfer current in the electric field formed by the first transfer charger 6 correlates with the second transfer current in the electric field formed by the second transfer charger 25. Therefore an optimal value of the first transfer current can be estimated based on the current I1 measured during the pre-rotation and the voltage applied to the second transfer charger 25 at that time. Thus it is possible to control the output of the first transfer charger 6 based on measurement result of the second transfer current I1 during the pre-rotation.

Although the present invention has been described in connection with the preferred embodiments above, it is to be noted that various changes and modifications are apparent to a person skilled in the art. Such changes and modifications are to be understood as being within the scope of the present invention defined by the appended claims.

For example, not only ordinary sheet but also special sheet such as OHP (over head projector) sheets may be used as copy sheets in such apparatuses.

As the transfer charger, a scorotoron charger whose output voltage toward the intermediate transfer belt can be adjusted by changing a voltage impressed on its grid may be used.

Further, the present invention may be adapted to transfer a toner image from the photosensitive drum to a copy sheet as well as used to transfer a toner image from the intermediate transfer belt to a copy sheet.

Furthermore, for the image exposure, not only an analog method using a visible ray but also a digital method using a laser beam may be adopted.

What is claimed is:

1. An image forming apparatus comprising:
a toner image carrying member;
means for providing the toner image carrying member with a toner image;
a transfer charger facing the toner image carrying member;
means for feeding a sheet between the toner image carrying member and the transfer charger;
means for supplying electric power to the transfer charger;
means for measuring electric charge applied to the sheet by the transfer charger; and
means for controlling the power supplying means so as to apply a specified amount of charge to the sheet, based on the measurement result by the measuring means.

2. An image forming apparatus as claimed in claim 1, wherein the toner image carrying member is a transfer belt to which a toner image formed on an electrostatic latent image carrying member is transferred;
the toner image providing means is a first transfer charger for transferring the toner image on the electrostatic latent image carrying member to the transfer belt; and
the transfer charger facing the toner image carrying member is a second transfer charger for transferring the toner image on the transfer belt to the fed sheet.

3. An image forming apparatus comprising:
a toner image carrying member;
means for providing the toner image carrying member with a toner image;
a transfer charger facing the toner image carrying member;
means for feeding a sheet between the toner image carrying member and the transfer charger;
means for supplying electric power to the transfer charger;
a conductive member disposed at the opposite side of the toner image carrying member from the transfer charger;
means for measuring an electric current flowing in the conductive member; and
means for controlling the power supplying means so as to cause a specified value of electric current to flow to the conductive member via the toner image carrying member, based on the measurement result by the measuring means.

4. An image forming apparatus as claimed in claim 3, wherein the control means controls the power supplying means so that the electric current flowing in the conductive member when no sheets exist between the toner image carrying member and the transfer charger becomes a specified value.

5. An image forming apparatus as claimed in claim 3, wherein the control means controls the power supplying means so that the electric current flowing in the conductive member when a sheet exists between the toner image carrying member and the transfer charger becomes a specified value.

6. An image forming apparatus as claimed in claim 3, wherein the toner image carrying member is a transfer belt to which a toner image formed on an electrostatic latent image carrying member is transferred;
the toner image providing means is a first transfer charger for transferring the toner image on the electrostatic latent image carrying member to the transfer belt; and
the transfer charger facing the toner image carrying member is a second transfer charger for transferring the toner image on the transfer belt to the fed sheet.

7. An image forming apparatus comprising:
a toner image carrying member;
means for providing the toner image carrying member with a toner image;
a transfer charger facing the toner image carrying member;
means for feeding a sheet between the toner image carrying member and the transfer charger;
means for supplying electric power to the transfer charger;
a conductive member disposed at the opposite side of the toner image carrying member from the transfer charger;
means for applying a bias voltage to the conductive member;
means for measuring an electric current flowing in the conductive member; and
means for controlling the bias voltage applying means so as to cause a specified value of electric current to flow to the conductive member via the toner image carrying member, based on the measurement result by the measuring means.

8. An image forming apparatus as claimed in claim 7, wherein the control means controls the bias voltage applying means so that the electric current flowing in the conductive member when no sheets exist between the toner image carrying member and the transfer charger becomes a specified value.

9. An image forming apparatus as claimed in claim 7, wherein the control means controls the bias voltage applying means so that the electric current flowing in the conductive member when a sheet exists between the toner image carrying member and the transfer charger becomes a specified value.

10. An image forming apparatus as claimed in claim 7, wherein the toner image carrying member is a transfer belt to which a toner image formed on an electrostatic latent image carrying member is transferred;
the toner image providing means is a first transfer charger for transferring the toner image on the electrostatic latent image carrying member to the transfer belt; and
the transfer charger facing the toner image carrying member is a second transfer charger for transferring the toner image on the transfer belt to the fed sheet.

11. An image forming apparatus comprising:
a toner image carrying member;
means for providing the toner image carrying member with a toner image;

a transfer charger facing the toner image carrying member;

means for feeding a sheet between the toner image carrying member and the transfer charger;

means for supplying electric power to the transfer charger;

a conductive member disposed at the opposite side of the toner image carrying member from the transfer charger;

means for measuring an electric current flowing in the conductive member; and means for controlling the power supplying means so as to cause a specified value of electric current to flow in a sheet between the toner image carrying member and the transfer charger, based on a first electric current flowing in the conductive member when a sheet exists between the toner image carrying member and the transfer charger, and a second electric current flowing in the conductive member when no sheets exist between the toner image carrying member and the transfer charger.

12. An image forming apparatus as claimed in claim 11, wherein the toner image carrying member is a transfer belt to which a toner image formed on an electrostatic latent image carrying member is transferred;

the toner image providing means is a first transfer charger for transferring the toner image on the electrostatic latent image carrying member to the transfer belt; and the transfer charger facing the toner image carrying member is a second transfer charger for transferring the toner image on the transfer belt to the fed sheet.

13. An image forming apparatus comprising:

a toner image holding member;

means for supplying electric charge to the toner image holding member via a sheet material in order to transfer a toner image formed on the toner image holding member onto said sheet material;

means for measuring electric current flowing in the toner image holding member;

means for estimating electric current passing through the sheet material based on the electric current measured by said measuring means; and means for controlling said supplying means so as to coincide the electric current estimated by said estimating means with a specified value.

14. An image forming apparatus as claimed in claim 13, wherein said supplying means includes a transfer charger facing the toner image holding member and means for supplying electric power to said transfer charger.

15. An image forming apparatus, comprising:

a toner image holding member;

means for supplying an electric charge to the toner image holding member via a sheet material in order to transfer a toner image formed on the toner image holding member onto said sheet material;

means for measuring electric current passing through the sheet material; and means for controlling said supplying means so as to coincide the electric current measured by said measuring means with a specified value.

16. An image forming apparatus as claimed in claim 15, wherein said measuring means includes a circuit which generates an output according to electric current flowing in the toner holding member and means for calculating electric current passing through the sheet material based on the output generated from said circuit.

17. An image forming apparatus as claimed in claim 15, wherein said supplying means includes a transfer charger facing the toner image holding member and means for supplying electric power to said transfer charger.

* * * * *